US008387540B2

(12) United States Patent
Merems

(10) Patent No.: US 8,387,540 B2
(45) Date of Patent: Mar. 5, 2013

(54) INTERCEPTOR PROJECTILE AND METHOD OF USE

(75) Inventor: Paul A. Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1234 days.

(21) Appl. No.: 12/189,302

(22) Filed: Aug. 11, 2008

(65) Prior Publication Data

US 2012/0210904 A1 Aug. 23, 2012

(51) Int. Cl.
*F42B 15/00* (2006.01)
*F41H 11/04* (2006.01)

(52) U.S. Cl. ..... 102/501; 102/502

(58) Field of Classification Search ..... 114/382; 342/62; 102/501, 502
See application file for complete search history.

(56) References Cited

U.S. PATENT DOCUMENTS

| | | | | |
|---|---|---|---|---|
| 1,211,001 | A | 1/1917 | Steinmetz | |
| 1,247,331 | A | 11/1917 | Robinson | |
| 1,274,419 | A | 8/1918 | Jackson | |
| 1,536,164 | A | 5/1925 | Tainton | |
| 2,296,980 | A * | 9/1942 | Carmichael | 102/504 |
| 2,308,683 | A | 1/1943 | Forbes | |
| 2,322,624 | A | 6/1943 | Forbes | |
| 3,710,720 | A * | 1/1973 | Mawhinney | 102/391 |
| 3,803,463 | A * | 4/1974 | Cover | 361/232 |
| 3,804,019 | A * | 4/1974 | Hurley | 102/448 |
| 4,090,567 | A * | 5/1978 | Tomlinson | 169/53 |
| 4,142,696 | A * | 3/1979 | Nottingham | 244/3.16 |
| 4,193,567 | A * | 3/1980 | McCarty, Jr. | 244/3.16 |
| 4,231,311 | A * | 11/1980 | Longerich | 114/244 |
| 4,253,132 | A * | 2/1981 | Cover | 361/232 |
| 4,833,995 | A * | 5/1989 | Gotz et al. | 102/521 |
| 5,069,109 | A * | 12/1991 | Lavan, Jr. | 89/1.11 |
| 5,280,843 | A * | 1/1994 | Vartija et al. | 473/576 |
| 5,495,787 | A * | 3/1996 | Boyer, III | 89/1.11 |
| 5,583,311 | A * | 12/1996 | Rieger | 89/1.11 |
| 5,750,918 | A * | 5/1998 | Mangolds et al. | 102/502 |
| 5,898,125 | A * | 4/1999 | Mangolds et al. | 102/439 |
| 5,988,036 | A * | 11/1999 | Mangolds et al. | 86/1.1 |
| 6,079,398 | A * | 6/2000 | Grimm | 124/16 |
| 6,220,918 | B1 * | 4/2001 | Laronge | 446/63 |
| 6,325,015 | B1 * | 12/2001 | Garcia et al. | 114/382 |

(Continued)

FOREIGN PATENT DOCUMENTS

JP 2002355323 A * 12/2002

OTHER PUBLICATIONS

"Force Protection Systems", Pacific Scientific Energetic Materials Company, [retrieved online], <http://www.psemc.com/force_protection.htm>, 2009.

(Continued)

*Primary Examiner* — Bret Hayes
*Assistant Examiner* — Joshua Freeman
(74) *Attorney, Agent, or Firm* — Renner, Otto, Boisselle & Sklar, LLP

(57) ABSTRACT

An interceptor projectile includes a deployable net that deploys during flight and wraps around an incoming projectile, such as a rocket propelled grenade (RPG). The net is initially in a tubular body of the interceptor projectile. Weights are attached to ends of the net with metal cables. A propellant is used to deploy the net from the tubular body and to deploy the weights at acute angles to the longitudinal axis of the interceptor projectile. The weights move radially out from the interceptor projectile, expanding the net outward, and wrapping the net around an incoming projectile. The engagement of the net with the incoming projectile disables the incoming projectile, sending the incoming projectile off course.

13 Claims, 4 Drawing Sheets

U.S. PATENT DOCUMENTS

| | | | | |
|---|---|---|---|---|
| 6,382,105 | B1 * | 5/2002 | Jones | 102/370 |
| 6,454,623 | B1 * | 9/2002 | Flatau | 446/34 |
| 6,626,077 | B1 * | 9/2003 | Gilbert | 89/1.11 |
| 6,854,374 | B1 * | 2/2005 | Breazeale | 86/50 |
| 6,904,838 | B1 * | 6/2005 | Dindl | 89/1.1 |
| 6,957,602 | B1 * | 10/2005 | Koenig et al. | 89/1.11 |
| 6,959,893 | B1 * | 11/2005 | Sadowski et al. | 244/3.16 |
| 7,190,304 | B1 | 3/2007 | Carlson | |
| 7,202,809 | B1 | 4/2007 | Schade et al. | |
| 7,328,644 | B2 * | 2/2008 | Vickroy | 89/1.11 |
| 7,398,617 | B2 * | 7/2008 | Mattox | 43/58 |
| 7,412,916 | B2 * | 8/2008 | Lloyd | 89/1.11 |
| 7,415,917 | B2 * | 8/2008 | Lloyd | 102/473 |
| 7,441,511 | B2 * | 10/2008 | Farinella et al. | 114/382 |
| 8,122,810 | B2 * | 2/2012 | Glasson | 89/1.11 |
| 2005/0016372 | A1 * | 1/2005 | Kilvert | 89/1.34 |
| 2005/0132923 | A1 * | 6/2005 | Lloyd | 102/477 |
| 2005/0183615 | A1 * | 8/2005 | Flatau | 102/503 |
| 2005/0192581 | A1 * | 9/2005 | Molz et al. | 606/74 |
| 2006/0112817 | A1 * | 6/2006 | Lloyd | 89/1.11 |
| 2006/0169832 | A1 * | 8/2006 | Glasson | 244/3.1 |
| 2006/0225598 | A1 * | 10/2006 | Okamoto et al. | 102/218 |
| 2007/0079819 | A1 * | 4/2007 | Vanek et al. | 124/16 |
| 2007/0180983 | A1 * | 8/2007 | Farinella et al. | 89/36.07 |
| 2007/0261542 | A1 * | 11/2007 | Chang et al. | 89/1.11 |
| 2008/0129166 | A1 * | 6/2008 | Benneche et al. | 312/292 |
| 2009/0114761 | A1 * | 5/2009 | Sells, II | 244/3.1 |
| 2009/0266226 | A1 * | 10/2009 | Beach et al. | 89/36.02 |
| 2010/0132580 | A1 * | 6/2010 | Nazdratenko | 102/502 |
| 2010/0307328 | A1 * | 12/2010 | Hoadley et al. | 89/36.02 |
| 2012/0011996 | A1 * | 1/2012 | Glasson | 89/36.17 |

OTHER PUBLICATIONS

"IABS—RPG Active Countermeasure", IABS RPG Countermeasure, (2002-2006), [retrieved online], <http://www.defence-update.com/products/i/IABS.htm>.

Application of Related U.S. Appl. No. 12/189,294, filed Aug. 11, 2008.

Application of Related U.S. Appl. No. 12/189,299, filed Aug. 11, 2008.

* cited by examiner

INTERCEPTOR PROJECTILE AND METHOD OF USE

BACKGROUND OF THE INVENTION

1. Technical Field of the Invention

The invention is in the field of devices and methods for defending against incoming projectiles.

2. Description of the Related Art

Rocket propelled grenades (RPGs) are examples of a type of projectile that poses a great threat to ground vehicles and helicopters. RPGs are commonly used during close-in military engagements, where the shooter and the target are close to one another. Defeating an incoming RPG with a fragmentation warhead interceptor may destroy the incoming RPG, but may also in the process produce a shower of fragments. These fragments may injure personnel or cause damage, such as by causing damage to a helicopter that is being fired upon. From the foregoing it will be appreciated that it may be desirable to have improved ways of dealing with incoming projectiles.

SUMMARY OF THE INVENTION

A weapons interceptor projectile includes a deployable net that wraps around and disables an incoming projectile. Metal weights are attached to ends of the net via metal cable lanyards. The metal weights are fired off from the projectile with a radial component of velocity. The net is also actively propelled with an explosive device. The weights aid in deploying the net quickly to its maximum area, and rotate around the center of the net during flight, aiding in wrapping the net around an incoming projectile. Substantially all of the device remains connected together, even after deployment. The net ensnares and disables the incoming projectile, causing the incoming projectile to miss its intended target. The interceptor projectile solves the fragmentation problem encountered by projectiles using warheads. In addition, ensnaring an incoming projectile using a net may advantageously allow capture and recovery of an enemy projectile.

According to an aspect of the invention, a weapon interceptor projectile includes a deployable net and weights attached to the ends of the net. The weights are deployed at an acute angle relative to a longitudinal axis of the interceptor projectile.

According to another aspect of the invention, a weapon interceptor projectile has separate propellant charges for deploying a net and weights attached to the net. The separate propellant charges are initiated by a single electrical igniter. Separate propellant charges are in respective propellant chambers that are in communication with one another.

According to yet another aspect of the invention, a weapon interceptor projectile has a deployable net that deploys from a tubular body after the interceptor projectile is fired.

According to a further aspect of the invention, a weapon interceptor projectile has a deployable net and weights that are attached to the end of the net. The weights are initially located aft of the net, and rotate about a center of the net during the deployment process. The weights may aid in wrapping the net around an incoming projectile after the incoming projectile has made contact with the net.

According to another aspect of the invention, a weapon interceptor projectile intercepts and non-explosively disables an incoming projectile.

According to yet another aspect of the invention, a weapon interceptor projectile includes: a tubular body; a net inside the tubular body; weights attached to cables that are attached to the net; and a propellant operatively coupled to the net and the weights and the net, for deploying the weights and the net.

According to still another aspect of the invention, a method of defending against an incoming projectile includes the steps of: firing an interceptor projectile toward the incoming projectile; after the firing, deploying a net and weights of the interceptor projectile; and wrapping the net around the incoming projectile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

An interceptor projectile includes a deployable net that deploys during flight and wraps around an incoming projectile, such as a rocket propelled grenade (RPG). The net is initially in a tubular body of the interceptor projectile. Weights are attached to ends of the net with metal cables. A propellant is used to deploy the net from the tubular body and to deploy the weights at acute angles to the longitudinal axis of the interceptor projectile. Separate propellant charges, in separate chambers that are in communication with one another, are used to propel both the weights and the net. A net piston is also propelled forward with the net. The weights move radially out from the interceptor projectile, expanding the net outward, and wrapping the net around an incoming projectile. The engagement of the net with the incoming projectile disables the incoming projectile, sending the incoming projectile off course. This successfully defends a target against the incoming projectile. The net may also be tethered to the rest of the projectile (including the tubular body and a base that contains the propellant chambers) through a wire rope-polymer tether. Thus substantially all of the parts of the interceptor projectile are mechanically linked together even after deployment of the net and the weights. This reduces the likelihood of collateral damage to nearby objects, including the target of the incoming projectile.

Figure 1:
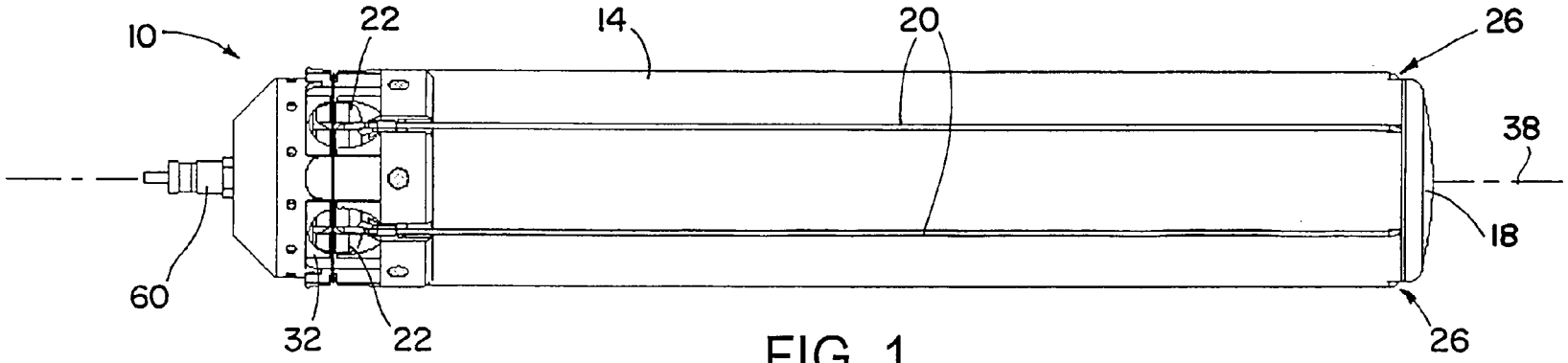
FIG. 1 is a plan view of an interceptor projectile in accordance with an embodiment of the present invention.
Figure 2:
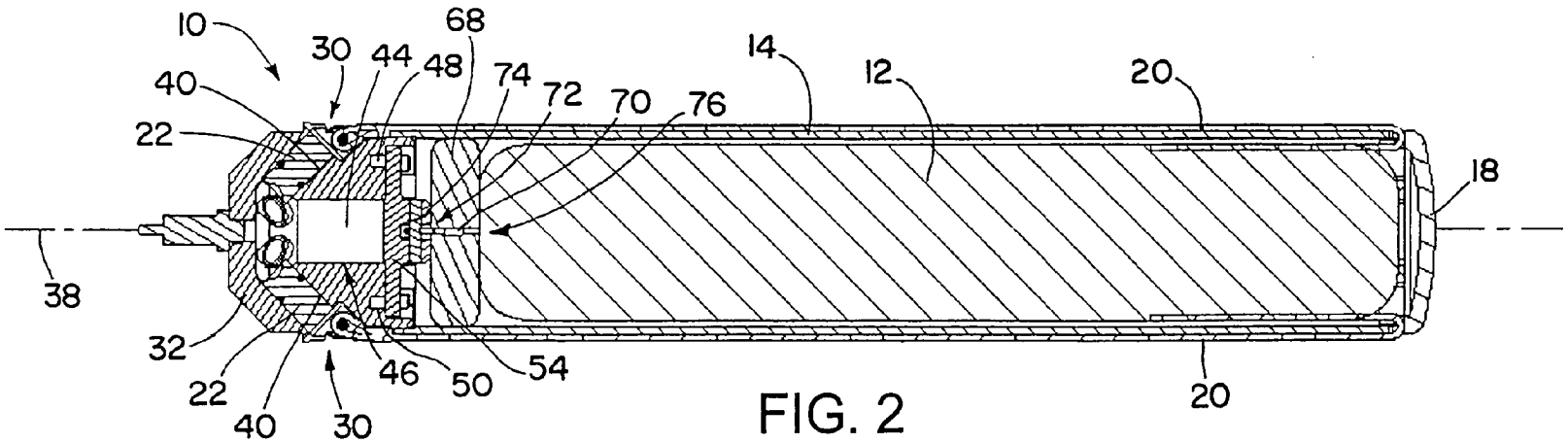
FIG. 2 is a cross-sectional view of the interceptor projectile of FIG. 1.
Figure 3:
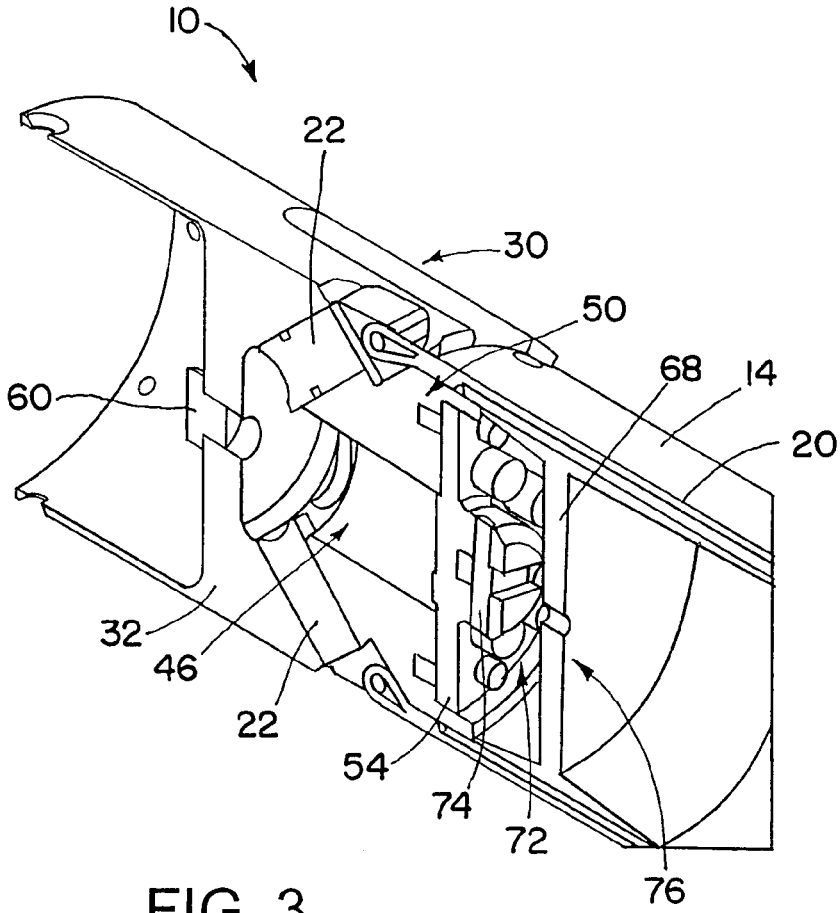
FIG. 3 is a cutaway view of part of the interceptor projectile of FIG. 1.

Referring initially to FIGS. 1-3, an interceptor projectile 10 includes a net 12 that is to be deployed and wrapped around an incoming projectile, such as a rocket propelled grenade (RPG). The net 12 is initially in a tubular body 14, and deploys from the tubular body 14. Prior to deployment of the net 12 a cap 18 covers the end of the tubular body 14 from which the net 12 is to be deployed. The net 12 may be a nylon net, or may have netting with another suitable material.

Cables or lanyards 20 link the net 12 to a series of weights 22. The cable lanyards may be wire rope-steel cables. The weights 22 may be made of a suitable material, such as cast metal. Steel or other suitable metals may be used. The cable lanyards 20 are attached to the net 12 within the tubular body 14. The cables 20 pass through cable openings 26 in the tubular body 14, adjacent to the nose cap 18, and pass longitudinally aft along the outside of the tubular body 14. The cables 20 are attached to the weights 22, with the weights 22 in angled holes 30 in a base 32 of the interceptor projectile 10. Loops at the ends of the cables 20 go around and are engaged with knobs or rods within the weights 22. The weights 22 may be held in place with tape or a restraining band, prior to being deployed. There are multiple end weights 22, each located in respect of one of the angled holes 30. In the illustrated embodiment there are six of the weights 22 axisymmetrically located about a longitudinal axis 38 of the interceptor projectile 10. It will be appreciated that there may be a greater or lesser number of the weights 22. The weights 22 function to rapidly deploy and expand the net 12 over an area. As explained in greater detail below, the weights 22 also are used in wrapping around and disabling an incoming projectile such as an RPG.

The weights 22 rest on angled surfaces 40 of the base 32. When the weights 22 are deployed from the base 32, the weights 22 head out on a trajectory at an acute angle to the longitudinal axis 38 of the interceptor projectile 10. The angle between the initial direction of travel of the weights 22 and the longitudinal axis 38 may be about 45°, although it will be appreciated that a large range of other angles may be utilized.

Both the net 12 and the weights 22 are deployed using gases from burning propellant charges. The propellant of the interceptor projectile 10 includes a weight propellant charge 44 in a primary propellant chamber 46 of the base 32, and a net propellant charge 48 in a secondary propellant chamber 50. The secondary propellant chamber 50 is between the base 32 and a top plate or vent plate 54 that is attached to the base 32. The propellant charges 44 and 48 are powdered propellant materials. The propellant chambers 46 and 50 are in communication with one another, such that initiation of detonation or combustion in one of the propellant charges 44 and 48 results in detonation or combustion in both of the propellant charges 44 and 48. To that end, the base 32 may have a cross-over channel or flash groove in it that links together the propellant chambers 46 and 50.

The pressure in the propellant chamber 50 may be regulated by means of vents on the face of the vent plate 54, to prevent buildup of excessive pressure within the propellant chamber 50.

An initiator 60 is located at the aft end of the primary propellant chamber 46, to ignite or detonate the weight propellant charge 44. The initiator 60 may be an electrical igniter, such as a squib. The initiation of combustion or detonation of the weight propellant charge 44 in the primary propellant chamber 46 produces pressurized gases. The primary propellant chamber 46 is in communication with the angled holes 30 that have the weights 22 in them. The pressure buildup in the primary propellant chamber 46 thus quickly provides a large pressure force that ejects the weights 22 out of the angle holes 30. As noted above, this ejection is at an acute angle relative to the longitudinal axis 38. Combustion in the primary propellant chamber 46 thus serves to forcibly eject the weights 22 away from the base 32.

Combustion of the weight propellant charge 44 also initiates combustion of the net propellant charge 48 in the secondary propellant chamber 50. Combustion of the net propellant charge 48 produces pressurized gases which pass through openings in the vent plate 54. The pressurized gases that pass through the vent plate 54 press against a piston or wadding 68 that is in contact with the net 12. The wadding 68 may be a suitable fiberglass material that fills the inside of the tubular body 14, and allows effective use of the pressurized gases to expel the net 12 from the tubular body 14. The presence of the wadding 68 confines the pressurized gases passing through the vent plate 54 to a relatively small volume, and keeps pressurized gases from escaping behind the net 12. In addition the wadding protects the net 12 from the hot gasses from the combustion of the propellant.

The vent plate 54 caps off both of the propellant chambers 46 and 50. Screws or other suitable fasteners may be used to secure the vent plate 54 to the base 32.

The net 12 remains tethered to the rest of the inceptor projectile 10 even after the net 12 is deployed. A tether 70 runs from the center of the net 12 to an attachment point 72 in the center of the vent plate 54. The attachment 72 may be a short rod 74 that an end of the tether 70 loops around. The tether 70 may be made of a wire rope-polymer. This hybrid material tether 70 is able to absorb shock while providing high strength. The tether 70 passes through a central hole 76 in the wadding or piston 68.

Figure 4:
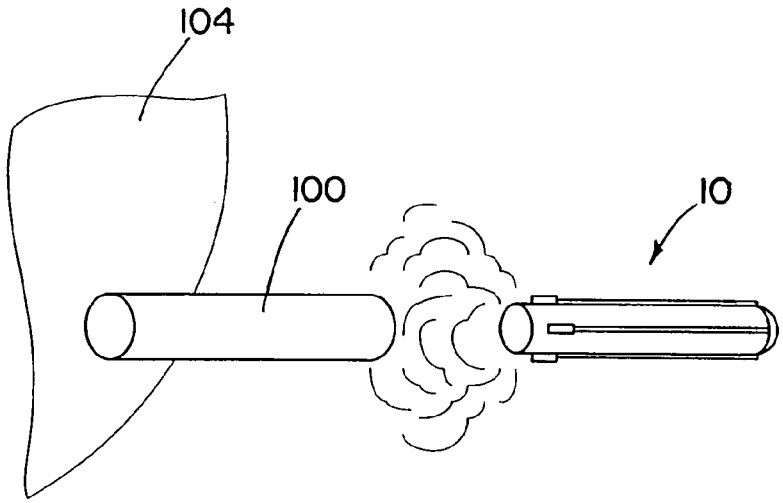
FIG. 4 illustrates a first step in use of the interceptor projectile of FIG. 1, according to an embodiment of the invention.

FIGS. 4-9 show steps in the deployment and use of the weapon interceptor projectile 10 to intercept an incoming projectile such as an RPG. FIG. 4 shows launch of the weapons projectile 10 from a launch tube 100 on a vehicle or structure 104. The vehicle or structure 104 may be any of a wide variety of movable or stationary objects. An example would be a helicopter or a ground vehicle such as a truck. The vehicle or structure 104 ordinarily would be the target of the incoming projectile. However, it will be appreciated that the vehicle or structure 104 that supports the launch tube 100 may be separate from the target for the incoming projectile.

The interceptor projectile 10 is fired from the launch tube 100 using any of a variety of well-known suitable methods for rapidly accelerating a projectile. An explosive charge that is placed in the launch tube 100 or that is part of the interceptor projectile 10 may be used to rapidly accelerate the interceptor projectile 10, firing the interceptor projectile 10 from the launch tube 100. It will be appreciated that non-chemical means may alternatively or in addition be used to fire the interceptor projectile 10. Examples of non-chemical acceleration mechanisms include use of magnetic forces and use of mechanical devices such as springs.

The interceptor projectile 10 may be fired from the launch tube 100 as soon as the firing of the incoming projectile is detected. Alternatively, firing of the interceptor projectile 10 may be delayed until the incoming projectile is a certain distance or time away from the launch tube 100 and/or the expected target of the incoming projectile. The firing of the interceptor projectile 10 may be made by a human operator or may be initiated automatically, such as by detection of the incoming projectile on radar or another tracking device.

Figure 5:
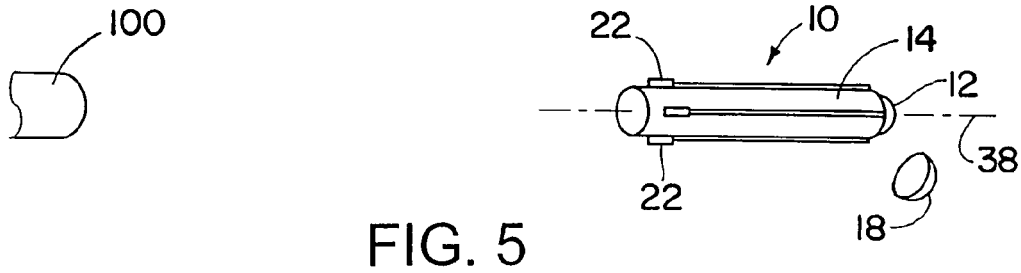
FIG. 5 illustrates a second step in the use of the interceptor projectile of FIG. 1.

FIG. 5 illustrates the initiation of the deployment of the net 12 and the weights 22. As described earlier deployment is started by firing of the initiator 60 to cause combustion or detonation of the propellant charges 44 and 48 (FIG. 2). This causes deployment of the net 12 out of the front end of the tubular body 14, pushing off the cap 18 of the interceptor projectile 10. The cap is made of a suitable lightweight material, and is blown off by the pressure pushing the net 12 out. (As an alternative, the cap 18 could be hingedly coupled to the tubular body 14.) At the same time, the weights 22 are ejected from the angled holes 30 (FIG. 2) at acute angles to the interceptor projectiles longitudinal axis 38.

It may be advantageous for the interceptor projectile 10 to proceed a certain minimum distance from the launch tube 100 before initiating deployment of the weights 22 and the net 12. This may be accomplished by using a time-delay fuse or an electronic circuit to delay firing of the initiator 60. Alternatively the interceptor projectile 10 may be configured to initiate deployment at a desired distance away from the incoming projectile. Such initiation may be accomplished by varying the time delay on the initiator 60 when the interceptor projectile 10 is initially fired from the launch tube 100. Alternatively, the initiator 60 may be fired using an external signal, such as a signal from the vehicle or structure 104 or from a separate control center, operator, or other device.

Figure 6:
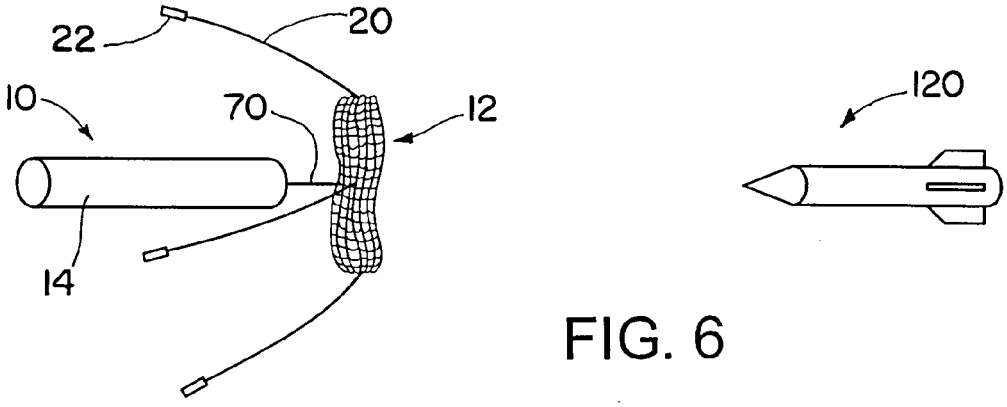
FIG. 6 illustrates a third step in the use of the interceptor projectile of FIG. 1.
Figure 7:
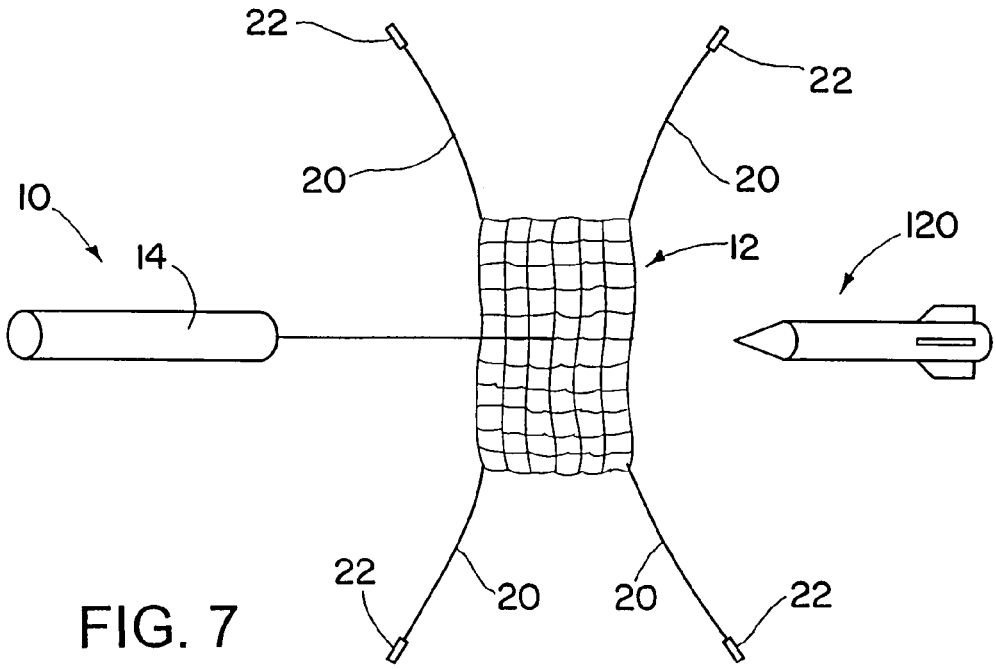
FIG. 7 illustrates a fourth step in the use of the interceptor projectile of FIG. 1.

FIGS. 6 and 7 show further deployment of the net 12 and the weights 22. The weights 22 may move faster than the center of the net 12, making the weights rotate to some extent relative to the center of the net 12 as the net 12 and the weights 22 both move toward the incoming projectile 120. The radially movement of weights 22 expand the net pulling it out to substantially its maximum deployed area, as shown in FIG. 7. It is advantageous to have the net 12 in a fully deployed condition, at substantially its maximum area, when the net 12 is approached by the incoming projectile 120.

As the net 12 and the weights 22 deploy, the net 12 remains attached to the tubular body 14 and the base 32, via the tether 70. The tether 70 is to some extent elastic, allowing stretching without breaking.

Figure 8:
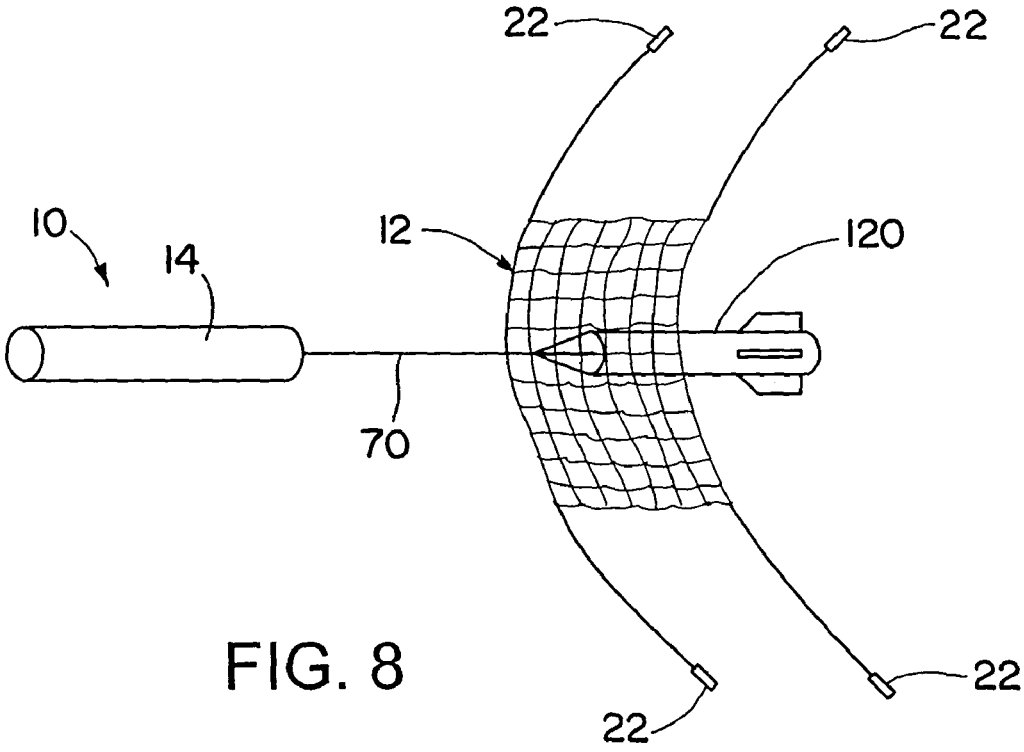
FIG. 8 illustrates a fifth step in the use of the interceptor projectile of FIG. 1.

FIG. 8 shows the initial contact between the incoming projectile 120 and net 12. The weights 22, which are not directly impacted by the incoming projectile 120, continue their forward movement past and around the incoming projectile 120. The weights 22 at the distal ends of the cables or lanyards 20 may act as "fingers" that close around the incoming projectile 120 in a manner analogous to the closing of the fingers of a hand around a small object held in the palm.

Figure 9:
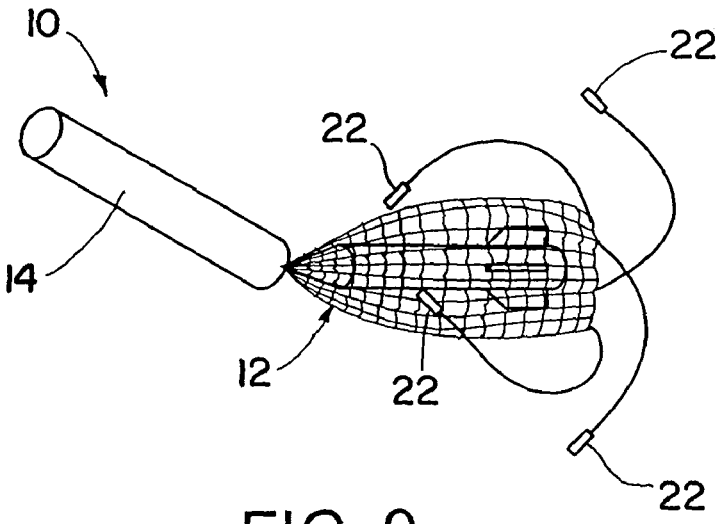
FIG. 9 illustrates a sixth step in the use of the interceptor projectile of FIG. 1.

FIG. 9 shows the conclusion of the process with the projectile 120 fully incased by the net 12. The weights 22 may be wrapped around the net 12 and the projectile 10 along any of a variety of paths or directions. This aids in securing the net 12 to the incoming projectile 120. Various parts of the interceptor projectile 10 contact and push the incoming projectile 120 in any of a variety of unpredictable directions, sending the incoming projectile 120 off course and keeping the incoming projectile 120 from reaching its intended target.

The deployment process illustrated in FIGS. 4-9 may occur on the order of milliseconds of time.

In deployment the weights 22 move radially outward, and then move back radially inward as they rotate about the center of the net 12. This inward rotation may be initiated by or accelerated by a collision between the incoming projectile 120 and the net 12.

One advantage of the interceptor projectile 10 is that substantially all of the projectile 10 remains mechanically coupled together even after deployment of the net 12 and the weights 22. This reduces or eliminates the number of stray parts or pieces that fly off at a high speed and may cause undesirable injuries or damage.

The wrapping of the net 12 securely around the incoming projectile 120 may also minimize the chances for undesirable collateral damage. In the event that the incoming projectile 120 fragments into pieces, either due to impact forces or due to fuel or an explosive on the incoming projectile 120 detonating, the net 12 may serve to secure together the resulting pieces or fragments of the incoming projectile 120. Even if the fragments are not completely secured, their destructiveness may be reduced by wrapping the incoming projectile 120 in the net 12. Again, by reducing or eliminating the number of additional pieces of high-speed material generated, undesired personnel injuries or physical damage advantageously may be reduced. Also, the interceptor projectile 10 disables the incoming projectile 120 without the use of explosives to destroy or disable the incoming projectile 120. By not using explosives there is no pressure wave created that might cause undesirable damage.

The deployment of the net 12 advantageously provides a large area which may snare the incoming projectile 120 even if the interceptor projectile 10 is not aimed precisely at the incoming projectile 120.

The interceptor projectile 10 may have any of a variety of sizes and configurations, and may be used for intercepting and disabling any of a variety of projectiles. An example of an alternative to an RPG is use of an interceptor projectile such as that described above to intercept and disable an unmanned air vehicle (UAV). One advantage of use of the interceptor projectile 10 is that it may be possible to disable the incoming projectile 120 without destroying the incoming projectile 120. It will be appreciated that in some instances it is desirable to capture and study an incoming projectile such as a UAV.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A weapon interceptor projectile comprising:

a tubular body;

a net inside the tubular body;

weights attached to cables that are attached to the net;

a propellant operatively coupled to the net and the weights and the net, for deploying the weights and the net; and a net piston inside the tubular body, between the net and the propellant, with the piston attached to the net; and wherein the net piston is propelled out of the tubular body along with the net, to deploy the net.

2. The projectile of claim 1, wherein the net piston includes fiberglass wadding.

3. A weapon interceptor projectile comprising:

a tubular body;

a net inside the tubular body;

weights attached to cables that are attached to the net; and a propellant operatively coupled to the net and the weights and the net, for deploying the weights and the net;

wherein the cables run along an outer surface of the tubular body.

4. The projectile of claim 3, further comprising a base that has angled holes in which the weights rest prior to deployment.

5. The projectile of claim 4, wherein the holes make an acute angle with a longitudinal axis of the interceptor projectile.

6. A method of defending against an incoming projectile, the method comprising:

firing an interceptor projectile toward the incoming projectile;

after the firing, deploying a net and weights of the interceptor projectile; and wrapping the net around the incoming projectile;

wherein the deploying includes igniting a propellant operatively coupled to the net and the weights, thereby separating the net and the weights from a body of the interceptor projectile;

wherein the separating includes moving the weights at an acute angle relative to a longitudinal axis of the interceptor projectile;

wherein the interceptor projectile includes a piston attached to the net by a tether; and wherein the separating includes moving the piston substantially along the longitudinal axis of the interceptor projectile.

7. The method of claim 6, wherein separating further includes rotating the weights about the piston as the piston moves.

8. The method of claim 6, wherein the propellant includes:

a weight propellant charge operatively coupled to the weights for deploying the weights; and a net propellant charge operatively coupled to the net for deploying the net;

wherein the propellant charges are in respective propellant chambers;

wherein the propellant chambers are in communication with one another; and wherein the deploying includes igniting both of the propellant charges using an initiator of the interceptor projectile.

9. The method of claim 6, wherein the wrapping includes the weights moving ends of the net, distal from a center of the net, around the incoming projectile.

10. The method of claim 6, wherein the deploying includes propelling both the net and the weights toward the incoming projectile.

11. The method of claim 10, wherein the propelling includes rotating the weights about a center of the net as the net and the weights move toward the incoming projectile.

12. The method of claim 6, wherein the deploying includes using the propellant to move the weights faster than a center of the net.

13. The method of claim 12, wherein the propellant includes:

a weight propellant charge operatively coupled to the weights for deploying the weights; and a net propellant charge operatively coupled to the net for deploying the net; and wherein the deploying includes using the weight propellant charge to move the weights faster than the net propellant charge moves the center of the net.

* * * * *